US005904129A

United States Patent [19]

Kadota

[11] Patent Number: 5,904,129

[45] Date of Patent: May 18, 1999

[54] CONTROL DEVICE FOR CYLINDER INJECTION TYPE INTERNAL-COMBUSTION ENGINE

[75] Inventor: Yoichi Kadota, Tokyo, Japan

[73] Assignee: Mitsubishi Denki Kabushiki Kaisha, Tokyo, Japan

[21] Appl. No.: 08/941,675

[22] Filed: Sep. 30, 1997

[51] Int. Cl.[6] ..... F02P 5/00

[52] U.S. Cl. ..... 123/406.45; 123/406.48

[58] Field of Search ..... 123/406.2, 406.21, 123/406.22, 406.27, 435, 436, 305, 406.45, 406.48

[56] References Cited

U.S. PATENT DOCUMENTS

| | | | |
|---|---|---|---|
| 4,633,844 | 1/1987 | Okimoto | 123/406.45 |
| 5,482,020 | 1/1996 | Shimizu et al. | 123/406.48 |
| 5,749,334 | 5/1998 | Oda et al. | 123/305 |

FOREIGN PATENT DOCUMENTS

| | | |
|---|---|---|
| A-43-32-171 | 3/1995 | Germany . |
| 43-36-775 | 4/1995 | Germany . |
| A-197-01-482 | 7/1997 | Germany . |
| 4-187819 | 7/1992 | Japan . |

*Primary Examiner*—John Kwon

*Attorney, Agent, or Firm*—Sughrue, Mion, Zinn, Macpeak & Seas, PLLC

[57] ABSTRACT

A control device for a cylinder injection type internal-combustion engine restrains the deterioration of combustion in the cylinder injection type internal-combustion engine which implements stratified charge combustion at a delicate fuel injection timing and a delicate ignition timing. The control device is equipped with a combustion state detector for detecting the deterioration of combustion in the internal-combustion engine, and a device for restraining the deterioration of combustion in the internal-combustion engine by gradually changing at least one parameter among the amount of exhaust gas to be recirculated, an ignition timing, and an air-fuel ratio when the combustion state detector has detected the deterioration of combustion in the internal-combustion engine.

3 Claims, 6 Drawing Sheets

CONTROL DEVICE FOR CYLINDER INJECTION TYPE INTERNAL-COMBUSTION ENGINE

BACKGROUND OF THE INVENTION

1. Field of the Invention

The present invention relates to a control device for a cylinder injection type internal-combustion engine which directly supplied fuel to a cylinder of an internal-combustion engine and, more particularly, to a control device for restraining the deterioration of combustion.

2. Description of Related Art

A cylinder injection type internal-combustion engine designed to directly supply fuel to the cylinders of an internal-combustion engine has been offering the hope of achieving a reduced displacement of exhaust gases, lower fuel cost, higher output, and improved drivability.

In a cylinder injection type internal-combustion engine, fuel is injected around a spark plug according to an ignition timing immediately before ignition, thereby producing flammable fuel around the spark plug to perform stratified charge combustion. At this time, the fuel-air mixture is unevenly distributed in a cylinder; the mixture has a value in the vicinity of a stoichiometric air-fuel ratio around the spark plug, whereas it is lean in other area. As a result, the apparent air-fuel ratio of the amount of inlet air to the amount of fuel supplied indicates a markedly lean fuel-air mixture.

Hence, extremely lean operation with an apparent air-fuel ratio of 30 or more can be accomplished, enabling a reduced displacement of exhaust gas and lower fuel cost to be achieved.

Further, since there is less fuel-air mixture around the spark plug, there is accordingly less end gas which is responsible for knocking, so that the compression ratio of an engine can be increased. In addition, the fuel which vaporizes in a cylinder takes the heat of vaporization; therefore, the density of introduced air rises with a resultant increase in volumetric efficiency, thus permitting higher output.

Since fuel is directly injected into a cylinder, it is unnecessary to consider the adherence of the fuel to the wall of an inlet pipe or a suction valve, allowing the mixture to be further lean. In addition, there is less time lag from the injection of fuel to the generation of output, enabling improved drivability.

As this type of cylinder injection internal-combustion engine, the one disclosed, for example, in Japanese Unexamined Patent Publication No. 4-187819 has been known.

In the cylinder injection type internal-combustion engine, although the apparent supply air-fuel ratio is 30 or higher and it indicates an extremely lean mixture, the air-fuel ratio in the area where actual combustion is taking place is in the vicinity of the stoichiometric air-fuel ratio, namely, 14.7. This means that the engine is operated in the vicinity of an air-fuel ratio of 16 at which a large amount of nitrogen oxide (NOx) is generated, whereas a lean burn engine is operated at an air-fuel ratio of approximately 20; therefore, a large amount of exhaust gas is recirculated to the intake end to reduce the generated nitrogen oxide.

Such a cylinder injection type internal-combustion engine performs the stratified charge combustion according to delicate timings for fuel injection and ignition. For this reason, if combustion deteriorates, it has been difficult to restrain the deterioration.

It has also been difficult to restrain the deterioration of combustion while restraining damage to the characteristics of the aforesaid cylinder injection type internal-combustion engine at the same time.

It has also been difficult to achieve a highly reliable device for securely restraining the deterioration of combustion.

It has been preferable to control the deterioration of combustion for each cylinder in order to control damage to the characteristics of the cylinder injection type internal-combustion engine.

SUMMARY OF THE INVENTION

The present invention has been made with a view toward solving the problems described above, and it is an object thereof to provide a control device for a cylinder injection type internal-combustion engine which is capable of restraining the deterioration of combustion in a cylinder injection type internal-combustion engine which requires delicate control.

It is another object of the present invention to provide a control device for a cylinder injection type internal-combustion engine which restrains the deterioration of combustion while restraining damage to the characteristics of a cylinder injection type internal-combustion engine at the same time.

It is yet another object of the present invention to provide a highly reliable control device for a cylinder injection type internal-combustion engine which ensures further reliable control of the deterioration of combustion.

To these ends, according to one aspect of the present invention, there is provided a control device for a cylinder injection type internal-combustion engine which is equipped with: an intake sensor for detecting the amount of air drawn into the internal-combustion engine or parameters related thereto; a crank angle sensor for detecting the crank angle of the internal-combustion engine; fuel controlling means for computing the amount of fuel to be supplied to the internal-combustion engine according to the detection results of at least the intake sensor and the crank angle sensor so as to set an air-fuel ratio for lean burning and also for directly supplying the computed amount of fuel to a cylinder of the internal-combustion engine when the internal-combustion engine is in a compression stroke; exhaust gas recirculating control means for recirculating exhaust gas to an inlet of the internal-combustion engine; combustion state detecting means for detecting the deterioration of combustion of the internal-combustion engine; and restraining means for gradually changing at least one parameter among the amount of exhaust gas to be recirculated, ignition timing, and air-fuel ratio so as to restrain the deterioration of combustion of the internal-combustion engine if the combustion state detecting means has detected the deterioration of combustion of the internal-combustion engine.

With this arrangement, the deterioration of combustion can be restrained while restraining damage to the characteristics of the cylinder injection type internal-combustion engine at the same time in the cylinder injection type internal-combustion engine requiring delicate control.

In a preferred form of the invention, the restraining means of the control device for the cylinder injection type internal-combustion engine controls at least ignition timing or air-fuel ratio, and it further reduces the amount of exhaust gas to be recirculated if the deterioration of combustion is not improved.

Thus, a highly reliable control device for a cylinder injection type internal-combustion engine which permits further reliable control of the deterioration of combustion is provided.

In a further preferred form of the invention, the restraining means of the control device for the cylinder injection type internal-combustion engine changes the fuel injection timing from a compression stroke to a suction stroke if reducing the amount of exhaust gas to be recirculated has failed to improve the deterioration of combustion.

In a still further preferred form of the invention, the restraining means of the control device for the cylinder injection type internal-combustion engine adjusts the air-fuel ratio to the vicinity of a stoichiometric air-fuel ratio to enrich the fuel-air mixture if changing the fuel injection timing has failed to improve the deterioration of combustion.

In another preferred form of the invention, the restraining means of the control device for the cylinder injection type internal-combustion engine controls the deterioration of combustion for each cylinder wherein the combustion has deteriorated.

Hence, the characteristics of a cylinder wherein no deterioration of combustion has taken place are not damaged.

According to another aspect of the invention, there is provided a control device for a cylinder injection type internal-combustion engine which is equipped with: an intake sensor for detecting the amount of air drawn into the internal-combustion engine or parameters related thereto; a crank angle sensor for detecting the crank angle of the internal-combustion engine; fuel controlling means for computing the amount of fuel to be supplied to the internal-combustion engine according to the detection results of at least the intake sensor and the crank angle sensor so as to set an air-fuel ratio for lean burning and also for directly supplying the computed amount of fuel to a cylinder of the internal-combustion engine when the internal-combustion engine is in a compression stroke; exhaust gas recirculating control means for recirculating exhaust gas to an inlet of the internal-combustion engine; combustion state detecting means for detecting the deterioration of combustion of the internal-combustion engine; and restraining means for changing the fuel supply timing from a compression stroke to a suction stroke so as to restrain the deterioration of combustion of the internal-combustion engine if the combustion state detecting means has detected the deterioration of combustion of the internal-combustion engine.

DESCRIPTION OF THE PREFERRED EMBODIMENTS

First Embodiment

Figure 1:
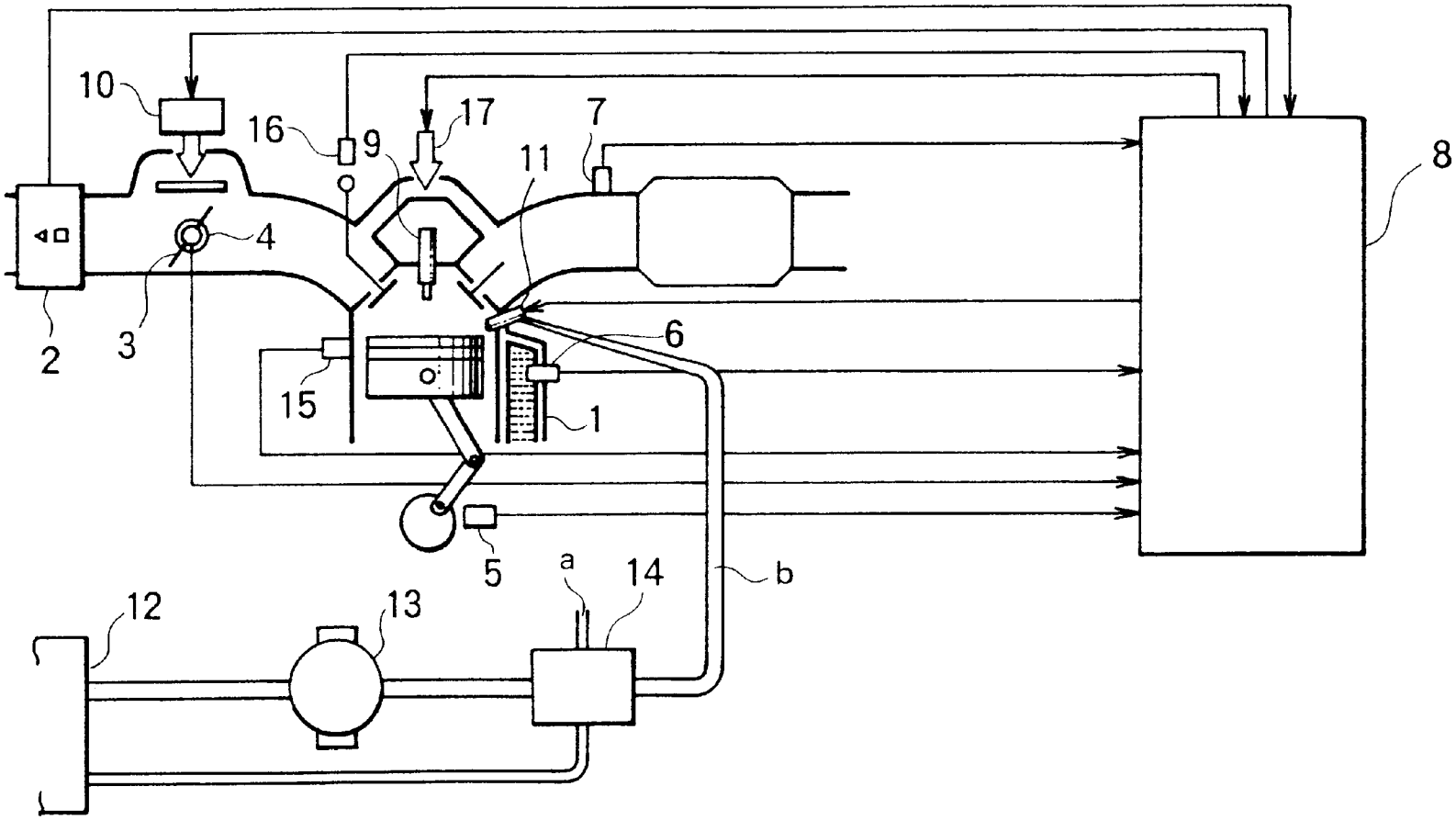
FIG. 1 is a block diagram showing the configuration of a first embodiment.

FIG. 1 is a block diagram showing the composition of a first embodiment. In the drawing, an airflow sensor 2 serving as an intake sensor measures the amount of air drawn into an automotive engine 1 or parameters related thereto. A throttle valve 3 circularly moves while being interlocked with an accelerator pedal, which is operated by a driver and which is not shown; it regulates the amount of air to be introduced into the engine 1. A throttle valve lift sensor 4 detects the position of the throttle valve 3. A crank angle sensor 5 detects the rotational speed of the engine 1 and the position of a crankshaft; a water temperature sensor 6 functions as a warm-up state detecting means for detecting the warm-up state of the engine; and an oxygen sensor 7 detects the concentration of oxygen of the exhaust gas discharged from the engine 1. An engine controlling means 8 receives information from various sensors mounted at various locations of the engine 1 to determine the operational state of the engine and computes various different control amounts according to the operational state, thereby carrying out diverse types of control. The engine controlling means 8 mainly implements the control of the air-fuel ratio for achieving combustion at a desired air-fuel ratio, the ignition timing control including knocking control so as to operate the engine at maximum efficiency, exhaust gas recirculating control for restraining the generation of NOx by recirculating exhaust gas to an inlet to perform re-combustion, fuel injection timing control for changing fuel injection timing in accordance with the operational state of the engine, the control of the number of revolutions during idling, and torque control during driving. The engine controlling means 8 also incorporates a restraining means for restraining the deterioration of combustion of the engine 1. A spark plug 9 provided in a cylinder of the engine 1 ignites a mixture. An air bypass valve 10 controls the number of revolutions during idling when the throttle valve 3 is fully closed and also controls the torque during driving so as to regulate the amount of air to be introduced in the engine, bypassing the throttle valve 3. An injector 11 is provided in a cylinder of the engine 1; it supplies fuel by injecting the fuel. The spark plug 9, the air bypass valve 10, and the injector 11 are controlled by the engine controlling means 8. A fuel pump 13 takes out fuel from a fuel tank 12. A fuel pressure regulator 14 controls the pressure of the fuel to be supplied to the injector 11; it regulates the fuel pressure so that the fuel pressure at portion b reaches a predetermined pressure level, the atmospheric pressure at portion a being the reference pressure level. In the cylinder injection type internal-combustion engine, a fuel pressure which is equal to the internal pressure of the cylinder or higher must be applied to the injector; therefore, the predetermined constant pressure is set to a value of a few tens, the atmospheric pressure providing the reference value. A knocking sensor 15 attached to the engine 1 detects the knocking of the engine 1; and a cylinder identifying sensor 16 attached to a cam shaft of the engine 1 identifies a burning cylinder. An EGR valve 17 regulates the amount of exhaust gas in the exhaust gas recirculating control in which exhaust gas is recirculated to the inlet of the engine 1 to carry out re-combustion.

Figure 2:
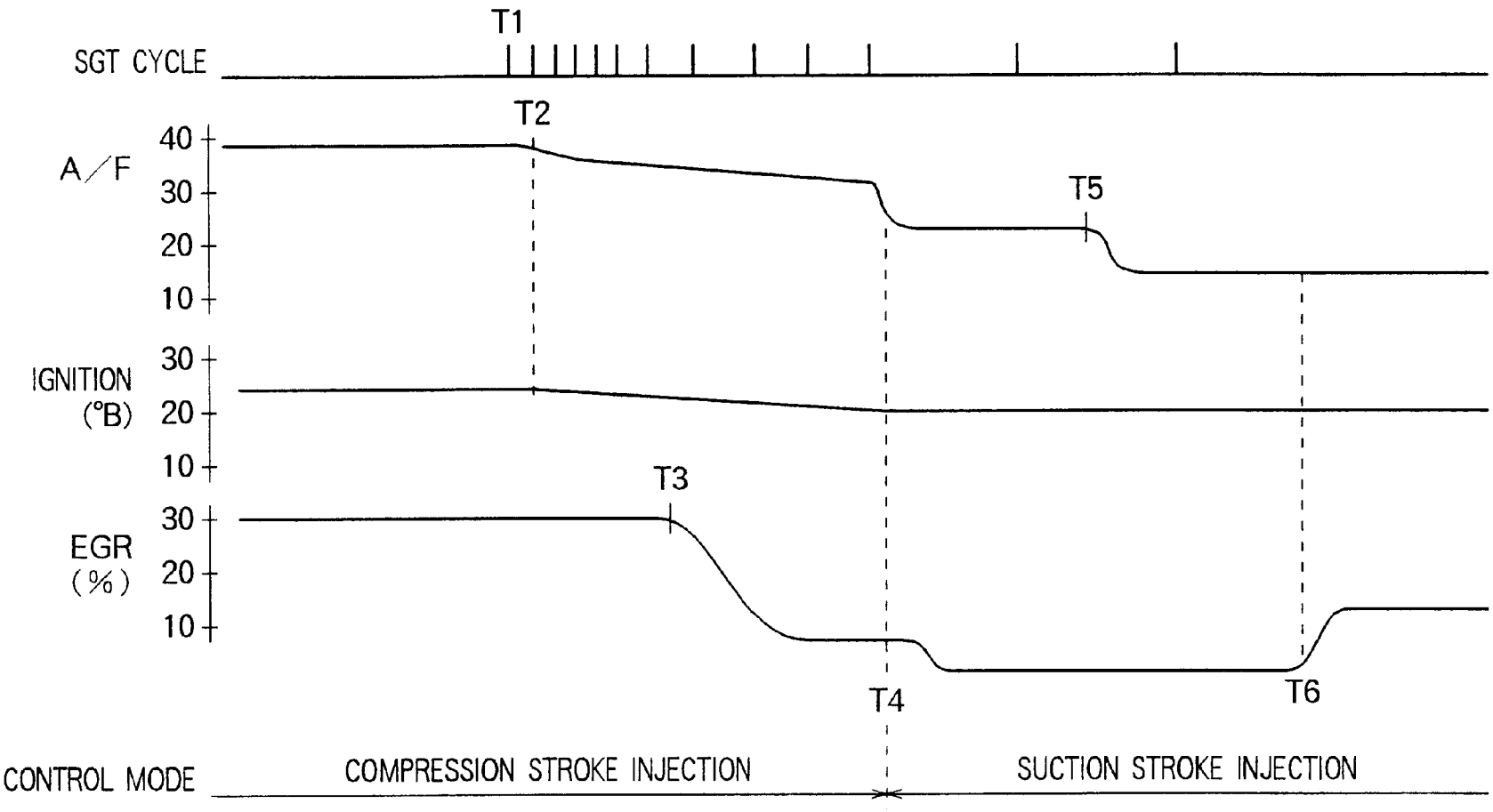
FIG. 2 is a timing chart illustrative of the control conducted in the first embodiment.

FIG. 2 is a timing chart illustrative of the control implemented by the first embodiment.

Before time T1, extremely lean drive with the air-fuel (A/F) ratio of 30 or more is performed and stratified charge combustion is implemented by injecting fuel in the compression stroke of the cylinder. The ignition timing is before 20 degrees (20 degrees B) or more of the top dead center (TDC), the amount of exhaust gas recirculation (EGR) being approximately 30%.

It is assumed that the combustion state detecting means, which will be discussed later, detects the deterioration of combustion or a misfire (hereinafter, both deterioration of combustion and a misfire will be referred to as "the deterioration of combustion") at time T1. To cope with the detected deterioration of combustion, the mixture is enriched gradually, starting at time T2, and the ignition timing is also delayed gradually to slowly change the parameters so as to permit stable combustion. If the deterioration of combustion is not improved despite the change of the parameters, then the amount of exhaust gas to be recirculated is gradually reduced from 30% to 10%, beginning at time T3, in order to improve the combustion. If the deterioration of combustion still remains unimproved, then the fuel injection timing is switched from the compression stroke to the suction stroke to effect a suction stroke injection lean mode. This means to stop the stratified charge combustion requiring delicate adjustment; instead, the fuel injected during the suction stroke is well mixed with introduced air in the cylinder, then ignited. If switching to the suction stroke injection lean mode has failed to control the deterioration of combustion, then the mixture is enriched, beginning at time T5, until the air-fuel ratio reaches a value in the vicinity of a stoichiometric air-fuel ratio (14.7) so as to implement the operation in a suction stroke injection stoichiometric mode.

When the improvement in the combustion is detected after one of the above parameters has been changed, the changed parameters including the air-fuel ratio, ignition timing, exhaust gas recirculating amount, and fuel injection timing are set back to original control settings in sequence. In the timing chart, it is shown that at time T6, the improvement of combustion is detected and the exhaust gas recirculating amount is set back to an original setting.

The control is conducted for each cylinder wherein deteriorated combustion has taken place so as to avoid affecting the output characteristics of normal cylinders.

In the above description, from time T2, the air-fuel ratio has been changed to enrich the mixture and the ignition timing has been delayed; however, only one of these parameters may be changed.

Alternatively, one of the parameters may be changed first, then the other parameter may be changed after that. For instance, changing the air-fuel ratio may be started at time T2 to gradually enrich the mixture, and if the combustion is not improved after a predetermined time has elapsed, then the ignition timing is also gradually delayed; and if the combustion still remains unimproved, then the amount of exhaust gas to be recirculated is gradually reduced, beginning at time T3.

Figure 3:
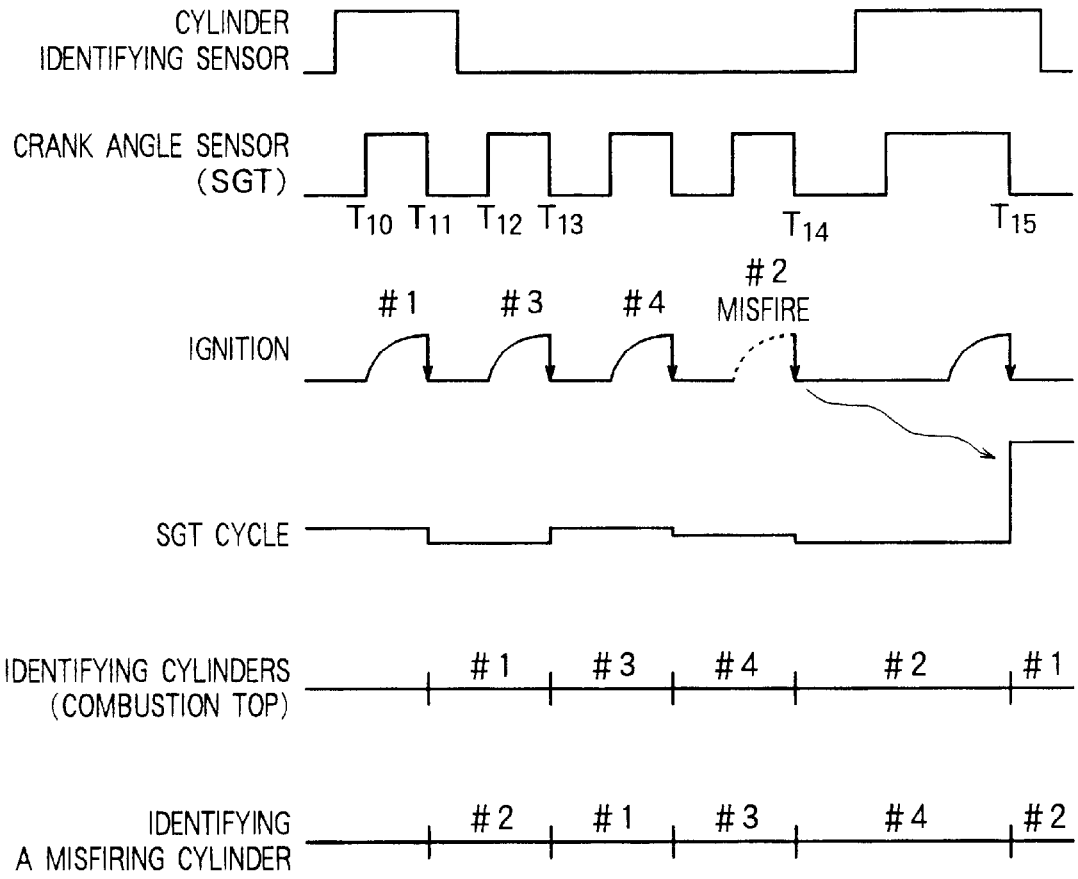
FIG. 3 is a timing chart illustrative of the operation of combustion state detecting means.

FIG. 3 is a timing chart illustrative of the operation of a combustion state detecting means which is included in the engine controlling means 8.

A cylinder identifying sensor 16 detects a first cylinder and issues a signal as illustrated. It is indicated that a certain cylinder is at 75 degrees before reaching its compression top dead center (TDC) at the rise of the signal of the crank angle sensor 5, and the cylinder is at its TDC at the fall of the signal.

Hence, the signal of the cylinder identifying sensor 16 and the signal of the crank angle sensor 5 make it possible to determine a cylinder and the state thereof. For example, it can be known that the cylinder is the first cylinder because the signal of the cylinder identifying sensor 16 is at a high level at time T10, and that the cylinder is at 75 degrees before reaching TDC because the signal of the crank angle sensor 5 is at its rise. Likewise, it can be seen that the first cylinder is at TDC at time T11.

The cylinder identifying sensor 16 does not issue a signal for a cylinder other than the first cylinder; however, each cylinder can be identified owing to a predetermined order of the cylinders.

More specifically, the sequence of the cylinders of the engine 1 is decided in advance. If, for example, the engine 1 has four cylinders, these cylinders are arranged in the order of the first cylinder, the third cylinder, the fourth cylinder, and the second cylinder. Hence, it is known that, when the first cylinder is identified by the cylinder identifying sensor 16, the third cylinder comes next. Therefore, it is known that the third cylinder is at 75 degrees before reaching TDC at time T12. The same method applies to other cylinders.

The variations in the revolution of the engine 1 are detected by measuring the signal cycle of the crank angle sensor 5, i.e. the time required for the crankshaft to turn by a predetermined angle. For instance, suppose that the falling cycle of the signal is measured as the signal cycle of the crank angle sensor 5. First, the output generated by ignition at time T11 causes the crankshaft to turn at a speed corresponding to the magnitude of the generated output. Accordingly, as the generated output is increased, the next fall can be detected more quickly.

Hence, it can be determined that the combustion state in the first cylinder is better as the measured time from T11 to T13 is shorter; in other words, it can be determined that the combustion state in the first cylinder is worse as the foregoing measured time is longer.

After that, the combustion state of each cylinder is detected in the same manner in the order of the third cylinder, the fourth cylinder, and the second cylinder.

FIG. 3 also illustrates a misfire that has taken place in the second cylinder for some reason. The time from T14 to T15 is extremely long, indicating that the output generated by ignition at time T14 was extremely small. In this case, it can be determined that the cylinder ignited at time T14, namely, the second cylinder, has incurred the misfire.

The operating procedure of the first embodiment will now be described in conjunction with the accompanying drawings.

Figure 4:
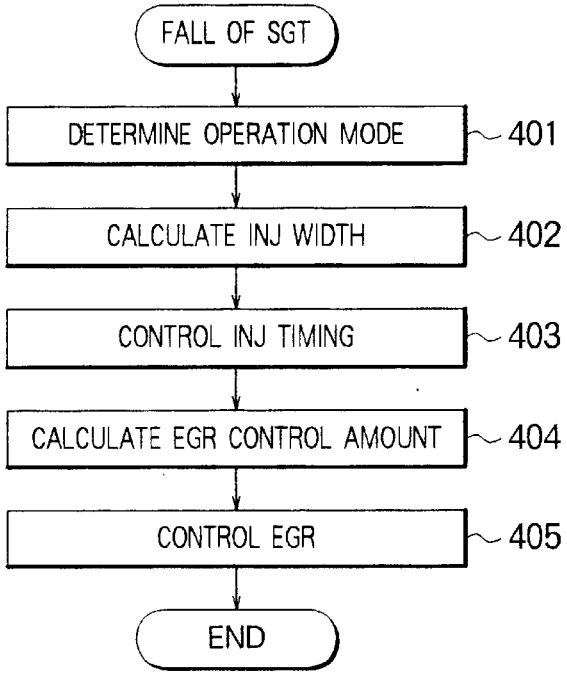
FIG. 4 is a flowchart illustrative of the summary of control conducted at the fall of a crank angle sensor signal.
Figure 5:
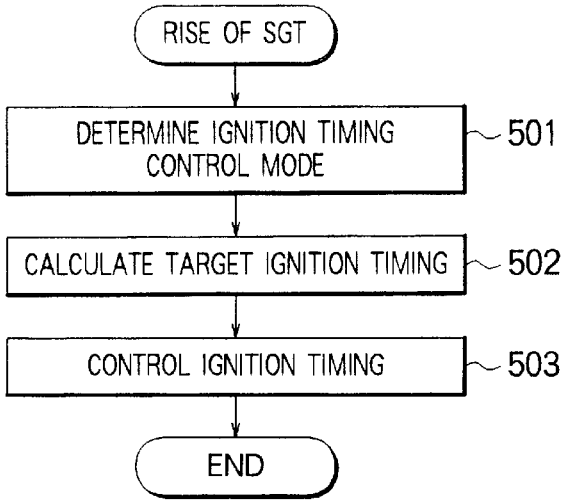
FIG. 5 is a flowchart illustrative of the summary of control conducted at the rise of a crank angle sensor signal.

FIG. 4 and FIG. 5 are flowcharts showing the summary of the control carried out by the first embodiment, wherein FIG. 4 illustrates the summary of the control started at the fall of the signal of the crank angle sensor 5, and FIG. 5 illustrates the summary of the control started at the rise of the signal of the crank angle sensor 5.

At the fall of the signal of the crank angle sensor 5, the procedure shown by the flowchart of FIG. 4 is begun. In step 401, the operational state of the engine 1 is judged according to the information received from the airflow sensor 2, the throttle valve lift sensor 4, the crank angle sensor 5, the water temperature sensor 6, and the oxygen sensor 7, and an operation mode is decided according to the operational state.

The operation mode mentioned above refers, for example, to a compression stroke injection mode wherein fuel is injected during the compression stroke, or a suction stroke injection mode wherein fuel is injected during the suction stroke. These modes are selected according to the operational state. Various other operation modes are available as necessary in addition to those related to fuel injection described above.

In the following step 402, the amount of fuel based on the operational state which has been determined in step 401 is calculated as driving width information for the injector 11; and in step 403, the driving timing for driving the injector 11 is calculated. In step 402, the amount of fuel is adjusted so as to perform extremely lean operation with the apparent air-fuel ratio of 30 or more when the combustion state in the engine 1 is good, and in step 403, adjustment is made so that the fuel is injected during the compression stroke. Step 402 and step 403 are involved in the fuel control means.

In step 404, an optimum amount of exhaust gas to be recirculated is computed in accordance with the operational state judged in step 401; and in step 405, a control signal for recirculating exhaust gas of the amount computed in step 404 to the inlet of the engine 1 is issued to the EGR valve 17, thus completing the processing. The amount of exhaust gas to be recirculated according to operational states is predetermined so that, when the combustion state of the engine 1 is good, a large amount of exhaust gas is introduced to the inlet to restrain the generation of NOx. Steps 404 and 405 are involved in the exhaust gas recirculating control means.

The output of the airflow sensor 2, i.e. the amount of introduced air, has been used for judging the operational state in step 401. The parameter, however, is not limited thereto; a parameter related to the amount of introduced air such as the negative pressure of the inlet pipe may be used instead.

The program illustrated by the flowchart of FIG. 5 is started at the rise of the signal of the crank angle sensor 5. In step 501, the operational state of the engine is determined according to the output of the diverse sensors as in step 401 described above. Based on the determination result, the ignition timing control mode is selected. The ignition timing must be decided according to whether the operation mode is the compression stroke injection mode or the suction stroke injection mode. Hence, in this step, the fuel injection mode is predicted from the operational state of the engine 1, and the ignition timing control mode is decided based on the predicted fuel injection mode.

In the following step 502, the ignition timing is computed according to the determined engine operational state and ignition timing control mode, and in step 503, an ignition timing signal for achieving the ignition timing which has been computed in step 502 is issued to the spark plug 9 before completing the procedure. Steps 502 and 503 are involved in the ignition timing controlling means.

Figure 6:
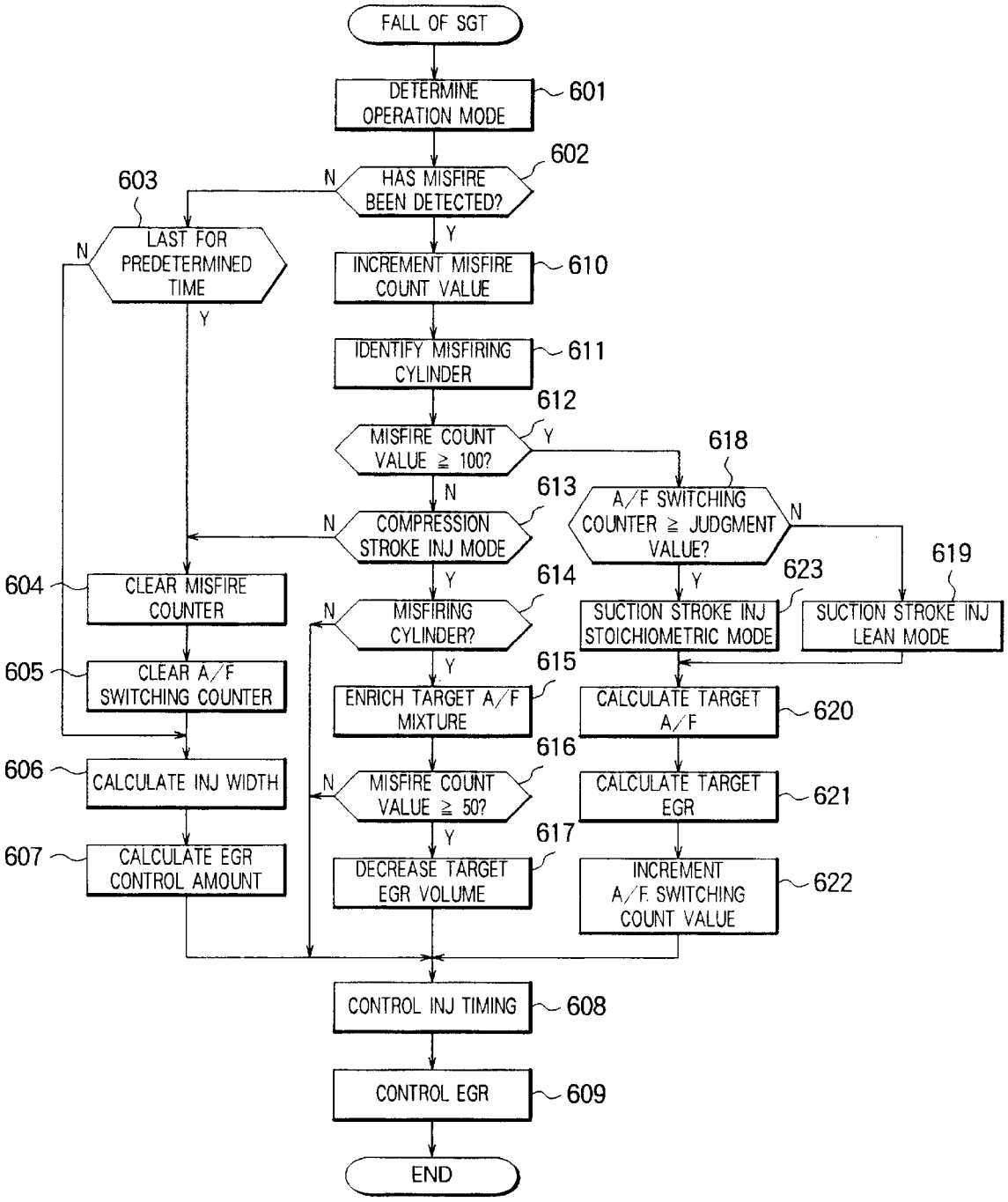
FIG. 6 is a flowchart illustrative of a detailed processing procedure at the fall of a crank angle sensor signal.

FIG. 6 shows more details of the flowchart shown in FIG. 4; the flowchart shown in FIG. 6 illustrates the processing procedure implemented by the first embodiment.

In step 601, the operational state of the engine 1 is determined according to the information received from the diverse sensors and the operation mode is decided based on the determined operational state. If the operation mode is changed in a subsequent step because of the deterioration of combustion, then the new operation mode is preferentially selected in step 601.

In the following description, it is assumed that the engine is in a state, wherein the compression stroke injection mode has been selected as the operation mode, and the stratified charge combustion is to be carried out.

In step 602, the combustion state of the engine 1 is detected according to the principle shown in FIG. 3. The state wherein the engine 1 is having stable stratified charge combustion is determined as "N" and the program proceeds to step 603. In step 603, the program decides whether the state wherein no deterioration in the combustion is detected has lasted for a predetermined time or more. If the engine 1 is having stable combustion, then the program determines as "Y" and proceeds to steps 604 and 605 to clear a misfire counter and an A/F switching counter which will be discussed later.

In step 606, the amount of fuel is computed as the driving width information for the injector 11 according to the operational state of the engine 1 which has been determined in step 601. In step 607, an optimum amount of exhaust gas to be recirculated is calculated according to the operational state of the engine 1 determined in step 601. In step 608, the timing for driving the injector 11 is computed according to the operation mode decided in step 601 and the injector 11 is driven at the computed timing. In step 609, the EGR valve 17 is controlled to recirculate exhaust gas of the amount computed in step 607 to the inlet.

The processing described above applies to the state wherein the engine 1 is implementing the stable stratified charge combustion. Step 601 corresponds to step 401 of FIG. 4; likewise, step 606 corresponds to step 402, step 607 corresponds to step 404, step 608 corresponds to step 403, and step 609 corresponds to step 405.

The following will describe a case where the deterioration of combustion takes place.

If the deterioration of combustion has occurred, the program determines as "Y" in step 602 and proceeds to step 610. In step 610, the misfire counter counts the number of deteriorations of combustion; the count value of the misfire counter indicates the frequency at which the deterioration of combustion is taking place. In step 611, the cylinder in which the deterioration of combustion has occurred is identified and stored in memory; the cylinder is identified using the signals issued by the crank angle sensor 5 and the cylinder identifying sensor 16.

In step 612, it is determined whether the value on the misfire counter is a first judgment value or more; the first judgment value is set, for example, to 100. If the determination result is "N" in step 612, then it means that the deterioration of combustion is observed but its frequency is low. This state does not require the fuel injection timing be changed to the suction stroke injection mode; therefore, the program proceeds to the processing step 613 and after to gradually change the parameters so as to stabilize the combustion.

In step 613, the program determines whether the fuel injection timing is in the compression stroke injection mode. If the determination result is negative, then the program proceeds to step 604 to implement the processing described above; or if the determination result is affirmative, then the program proceeds to step 614 to implement the processing for restraining further deterioration of combustion. This step 613 is intended to carry out the processing for controlling the deterioration of combustion only in the compression stroke injection mode wherein combustion is apt to be unstable. In the suction stroke injection mode wherein combustion tends to be stable, the processing in step 614 through 617, which will be discussed later, are prohibited. Step 613 is involved in the prohibiting means which prohibits changing a parameter in the suction stroke injection mode.

In step 614 through step 617, the processing for stabilizing combustion by gradually changing the parameters is implemented. It should be noted that each parameter must be changed gradually since the stratified charge combustion requires delicate adjustment to accomplish stable combustion. Gradually changing the parameters also makes it possible to control the deterioration of combustion while minimizing damage to the characteristics of the engine.

In step 614, it is determined whether the present cylinder to be ignited is the one that has developed the deterioration in combustion. If the determination result is negative, then it means that it is having stable stratified charge combustion; therefore, the program does not do anything and proceeds to step 608 to carry out the subsequent processing.

If the determination result in step 614 is affirmative, then the program proceeds to step 615 to adjust a target air-fuel ratio, i.e. the air-fuel ratio set to 30 or more in a normal state, so as to enrich the mixture by a predetermined value. This processing is repeated at every fall of the signal of the crank angle sensor 5 to gradually adjust the target air-fuel ratio to enrich the mixture.

If the adjustment of the target air-fuel ratio for enriching the mixture has failed to improve the deterioration of combustion, then the count value on the misfire counter is gradually incremented until it reaches a second judgment value, namely, 50. If the count value on the misfire counter exceeds 50, then the determination result in step 616 becomes affirmative, and the target amount of exhaust gas to be recirculated is reduced by a predetermined value in step 617. In other words, if the deterioration of combustion still remains unimproved despite the adjustment of the target air-fuel ratio which has been made to enrich the mixture, then the amount of exhaust gas to be recirculated is gradually decreased to achieve stable combustion. This processing is repeated at every fall of the signal of the crank angle sensor 5 so as to gradually reduce the target amount of exhaust gas to be recirculated.

If the deterioration of combustion still cannot be restrained even after the target air-fuel ratio has been adjusted to enrich the mixture and the amount of exhaust gas to be recirculated has been decreased, that is, if the count value on the misfire counter reaches 100 or more and the determination result in step 612 is affirmative, then the program proceeds to step 618 and after to change the fuel injection mode from the compression stroke injection to the suction stroke injection.

In step 618, it is determined whether the value on the A/F switching counter is a third judgment value or more. The A/F switching counter is incremented in a step which will be discussed later; it is used to determine whether the fuel injection mode should be set to the suction stroke injection lean mode or the suction stroke injection stoichiometric mode which will be described later.

When the program goes to step 618 for the first time, the value on the A/F switching counter is zero, so that the determination result will be negative; the program then proceeds to step 619 wherein it changes the fuel injection mode to the suction stroke injection lean mode. In the suction stroke injection lean mode, fuel is injected during the suction stroke, the target air-fuel ratio being set to about 20 to about 25.

Thus, if the deterioration of combustion cannot be controlled, the target air-fuel ratio, which is set to about 30 to about 40 in the normal state, is gradually changed to enrich the mixture, beginning at time T2. If this fails to accomplish stable combustion, then the amount of exhaust gas to be recirculated is gradually decreased from about 30% to about 10%, beginning at time T3. If this still fails to improve the deterioration of combustion, then the target air-fuel ratio is set to about 20 to about 25 and the fuel injection timing is changed from the compression stroke to the suction stroke, beginning at time T4.

In step 620, the target air-fuel ratio is computed according to a selected fuel injection mode; and in step 621, the target amount of exhaust gas to be recirculated is computed. In step 622, the count value of the A/F switching counter is incremented, and in steps 608 and 609, the fuel of the amount computed in the aforesaid step 620 and the exhaust gas of the amount computed in the aforesaid step 621 are supplied at predetermined timings.

If the combustion state is not improved within a predetermined period of time even after changing to the suction stroke injection lean mode, that is, if the determination result in step 618 is affirmative, then the program proceeds to step 623 wherein it changes the injection mode to the suction stroke injection stoichiometric mode. In the suction stroke injection stoichiometric mode, fuel is injected during the suction stroke; the target air-fuel ratio is set to a value in the neighborhood of the stoichiometric air-fuel ratio, namely, 14.7.

When the suction stroke injection stoichiometric mode has been selected, the target air-fuel ratio and the amount of exhaust gas to be recirculated are computed according to the suction stroke injection stoichiometric mode in steps 620 and 621.

If the combustion state is improved after any of the above corrective processings has been implemented, then the determination result in step 602 is negative and that in step 603 is affirmative, and the misfire counter and the A/F switching counter are cleared in step 604 and step 605, respectively.

At the next fall of the signal of the crank angle sensor 5, the operation mode based on the operational state of the engine is determined in step 601, and normal control is carried out.

In the example described above, the air-fuel ratio, the amount of exhaust gas to be recirculated, and the fuel injection timing have been used as the parameters changed to improve the deterioration of combustion; ignition timing may also added to these parameters.

Figure 7:
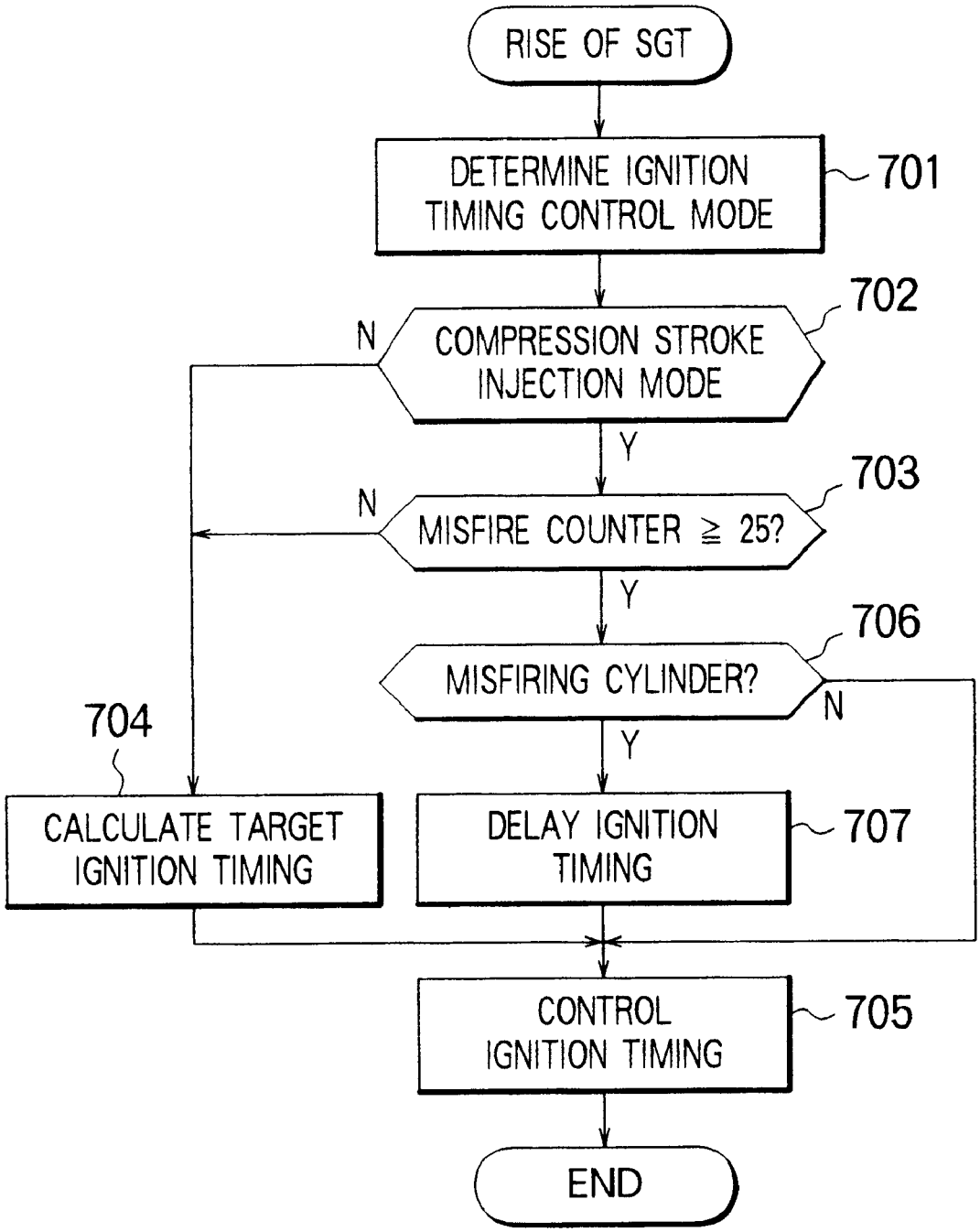
FIG. 7 is a flowchart illustrative of a detailed processing procedure at the rise of a crank angle sensor signal.

FIG. 7 shows more details of the flowchart of FIG. 5; it illustrates the gradual change of ignition timing when the deterioration of combustion occurs.

Step 701 corresponds to step 501; the ignition timing control mode is determined according to the operational state of the engine 1 which has been determined by the information received from the diverse sensors. The following step 702 is the step wherein the ignition timing is gradually changed to control the deterioration of combustion only when it is determined that the compression stroke injection mode has been set; this step is involved in the prohibiting means as in the case of step 613.

If the compression stroke injection mode has been set, then the program proceeds to step 703 wherein it decides whether the combustion has deteriorated according to a fourth judgment value. If it is determined in step 703 that the combustion has not deteriorated or if it is determined in step 702 that the injection mode is not the compression stroke injection mode, then the program proceeds to step 704 and after to compute the target ignition timing and to perform control so as to ignite the spark plug 9 at the computed target ignition timing.

Step 701 corresponds to step 501. Likewise, step 704 corresponds to 502, and step 705 corresponds to step 503.

In step 703, if the program decides that the value on the misfire counter is the fourth judgment value or more, then it proceeds to step 706 wherein it determines whether the cylinder to be controlled this time is the one that has incurred the deterioration of combustion. If the program decides that the cylinder is not the one that has developed the deteriorated combustion, then it proceeds to step 705 to finish the processing; or if the program decides that the cylinder is the one that has the deteriorated combustion, then it delays the target ignition timing by a predetermined value to stabilize the combustion.

This processing is repeated at every rise of the signal of the crank angle sensor 5 to gradually delay the ignition timing.

In this case, the fourth judgment value is set to 25. Thus, when the deterioration of combustion is detected, the target air-fuel ratio is adjusted to gradually enrich the mixture by the processing of step 615 first, and if this fails to improve the combustion state, then the ignition timing is gradually delayed by the processing of step 707 when the count value on the misfire counter exceeds 25 which is the fourth judgment value. If this still fails to improve the combustion state, then the amount of exhaust gas to be recirculated is gradually decreased by the processing of step 617 when the count value on the misfire counter exceeds 50 which is the second judgment value.

In the first embodiment described above, the parameters have been changed in the order of the target air-fuel ratio, the ignition timing, and the amount of exhaust gas to be recirculated; however, the changing order is not limited thereto, and it may be set as desired.

In the first embodiment, multiple parameters have been changed. Alternatively, however, only one of the parameters may be changed instead of changing multiple parameters.

Further, in the first embodiment, when the combustion state has not been improved by changing the parameters, the injection mode has been changed from the compression stroke injection over to the suction stroke injection. Alternatively, however, the injection mode may be switched from the compression stroke injection to the suction stroke injection at the moment when the deterioration of combustion is detected.

The invention may be embodied in other specific forms without departing from the spirit or essential characteristics thereof. The present embodiment is therefore to be considered in all respects as illustrative and not restrictive.

What is claimed is:

1. A control device for a cylinder injection type internal-combustion engine, comprising:

an intake sensor for detecting the amount of air drawn into an internal-combustion engine:

a crank angle sensor for detecting a crank angle of said internal-combustion engine:

fuel controlling means for computing the amount of fuel to be supplied to said internal-combustion engine according to respective detection results of at least said intake sensor and said crank angle sensor so as to set an air-fuel ratio for lean burning and for directly supplying a computed amount of fuel to a cylinder or said internal-combustion engine when said internal-combustion engine is in a compression stroke:

exhaust gas recirculating control means for recirculating exhaust gas to an inlet of said internal-combustion engine;

combustion state detecting means for detecting a deterioration of combustion of said internal-combustion engine: and retraining means for gradually changing at least one parameter among the amount of gas to be recirculated, ignition timing, and air-fuel ratio so as to restrain the deterioration of combustion of said internal-combustion engine when said combustion state detecting means has detected the deterioration of combustion of said internal-combustion engine:

wherein said restraining means controls at least ignition timing or air-fuel ratio, and also reduces the amount of exhaust gas to be recirculated when the deterioration of combustion is not improved:

wherein said restraining means changes fuel injection timing from a compression stroke to a suction stroke when reducing the amount of exhaust gas to be recirculated has failed to improve the deterioration of combustion.

2. A control device for a cylinder injection type internal-combustion engine, comprising:

an intake sensor for detecting the amount of air drawn into an internal-combustion engine;

a crank angle sensor for detecting a crank angle of said internal-combustion engine:

fuel controlling means for computing the amount of fuel to be supplied to said internal-combustion engine according to respective detection results of at least said intake sensor and said crank angle sensor so as to set an air-fuel ratio for lean burning and for directly supplying a computed amount of fuel to a cylinder or said internal-combustion engine when said internal-combustion engine is in a compression stroke:

exhaust gas recirculating control means for recirculating exhaust gas to an inlet of said internal-combustion engine:

combustion state detecting means for detecting a deterioration of combustion of said internal-combustion engine: and retraining means for gradually changing at least one parameter among the amount of gas to be recirculated, ignition timing, and air-fuel ratio so as to restrain the deterioration of combustion of said internal-combustion engine when said combustion state detecting means has detected the deterioration of combustion of said internal-combustion engine:

wherein said restraining means controls at least ignition timing or air-fuel ratio, and also reduces the amount of exhaust gas to be recirculated when the deterioration of combustion is not improved:

wherein said restraining means changes fuel injection timing from a compression stroke to a suction stroke when reducing the amount of exhaust gas to be recirculated has failed to improve the deterioration of combustion:

wherein said restraining means adjusts the air-fuel ratio to the vicinity of a stoichiometric air-fuel ratio to enrich a mixture when changing the fuel injection timing has failed to improve the deterioration of combustion.

3. A control device for a cylinder injection type internal-combustion engine according to claim 1, wherein said restraining means controls the deterioration of combustion for each cylinder wherein the combustion has deteriorated.

* * * * *